United States Patent [19]

Maier et al.

[11] 4,414,438

[45] Nov. 8, 1983

[54] VIDEO GAME CONTROLLER

[75] Inventors: Bruce Maier, Columbia, Mo.; Brian J. Maloney, St. Charles, Ill.

[73] Assignee: International Jensen Incorporated, Schiller Park, Ill.

[21] Appl. No.: 384,923

[22] Filed: Jun. 4, 1982

[51] Int. Cl.[3] ..... H01H 25/04

[52] U.S. Cl. ..... 200/6 A; 200/18; 200/153 K; 200/157

[58] Field of Search ..... 200/6 A, 17 R, 18, 5 A, 200/153 K, 157

[56] References Cited

U.S. PATENT DOCUMENTS

| | | | |
|---|---|---|---|
| 3,283,088 | 11/1966 | Scow et al. | 200/6 A |
| 3,293,381 | 12/1966 | Eitel | 200/6 A |
| 3,365,975 | 1/1968 | Hathaway | 200/6 A X |
| 3,731,013 | 5/1973 | Nightengale | 200/6 A X |
| 4,027,119 | 5/1977 | Tezuka | 200/6 A |
| 4,256,931 | 3/1981 | Palisek | 200/6 A X |
| 4,330,694 | 5/1982 | Ogawa | 200/6 A |
| 4,349,708 | 9/1982 | Asher | 200/6 A |

*Primary Examiner*—J. R. Scott

*Attorney, Agent, or Firm*—Willian, Brinks, Olds, Hofer, Gilson & Lione, Ltd.

[57] ABSTRACT

A video game joystick controller is disclosed which includes a lower housing which defines a lower convex bearing surface, an upper housing which defines an upper concave bearing surface concentric with the lower bearing surface, and a handle which defines inner and outer bearing surfaces. The inner bearing surface of the handle is adapted to mate with the lower bearing surface of the lower housing, and the outer bearing surface of the handle is adapted to mate with the upper bearing surface of the upper housing such that the handle is free to pivot with a smooth action. A plate is mounted to the lower end of the handle, and this plate bears four switch actuators, one of which is higher than the other three. A circuit board is mounted to the upper housing, and it serves to mount four coplanar switches, each of which is situated directly above a respective one of the four actuators. The longer one of the four actuators is associated with rearward motion of the handle such that a reduced angular movement of the handle away from a central position is required to actuate the switch associated with rearward movement of the handle that is required to actuate any of the other three switches. A thumb operated trigger switch is positioned on top of the handle.

13 Claims, 8 Drawing Figures

VIDEO GAME CONTROLLER

BACKGROUND OF THE INVENTION

This invention is directed to an improved joystick-type controller for use with video games.

A wide variety of video games utilize a joystick-type controller. Such controllers can be used by an operator to provide a digital input signal to a video game indicative or a preferred or intended direction of travel. Conventional joystick-type controllers include four digital switches and a central handle. The operator determines the angular position of this handle in order to actuate any one of the four switches or any two adjacent pairs of switches.

In view of the rapid play of many video games, smooth movement and operation of a video game controller is critically important to many users. A need exists for an improved video game controller having a smooth joystick action conducive to precision operation.

SUMMARY OF THE INVENTION

The present invention is directed to an improved joystick-type video game controller which provides such smooth operation, and which embodies a number of improvements that render it easily manufactured, durable, and easily used.

According to a first feature of this invention, two nested spherical bearings are used to capture the joystick handle securely within the housing. These two spherical bearings are concentric, and they provide smooth pivotal motion to the handle regardless of axial forces on the handle. Thus, the angular position of the handle is not disturbed when axial forces are applied to the handle during play.

According to a second feature of this invention, the joystick handle is provided with a plate within the housing which defines four upwardly facing protrusions, each of which serves to actuate a respective switch mounted within the housing. One of these four protrusions is longer than the other three such that the handle must be moved through a smaller angular arc from a central position to actuate the switch associated with this longer protrusion than that required to actuate the remaining switches. It has been found that for many operators it is more difficult to pull a joystick handle rearwardly than in any of the other three directions. This feature of the invention makes possible a joystick-type controller which is markedly easier to use in actuating the switch associated with rearward movement of the joystick handle.

According to a third feature of this invention, a thumb actuated trigger is positioned centrally on an upper end of the joystick handle. This placement of the trigger switch results in a joystick-type controller which can be used as readily by a right-handed player as by a left-handed player.

The invention itself, together with further objects and attendant advantages, will best be understood by reference of the following detailed description taken in conjunction with the accompanying drawings.

DETAILED DESCRIPTION OF THE PRESENTLY PREFERRED EMBODIMENTS

Figure 1:
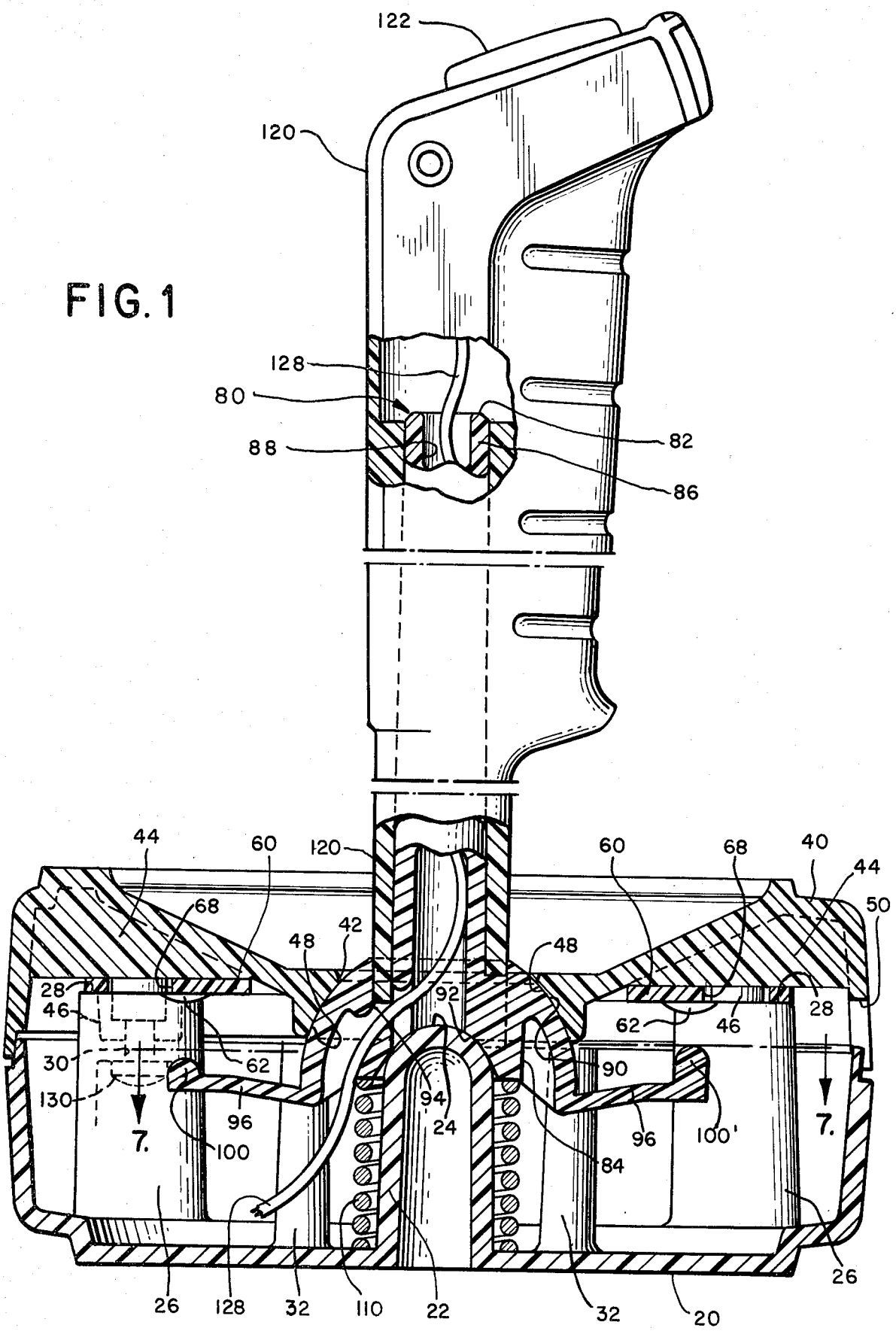
FIG. 1 is a cross-sectional view of a presently preferred embodiment of this invention.

Turning now to the drawings, FIG. 1 shows a cross-sectional view of a presently preferred embodiment of this invention. This embodiment is made up of five major structural components: a lower housing 20, an upper housing 40, a circuit board 60, a handle 80, and a grip 120. The following discussion will discuss each of these components separately with the aid of FIGS. 2 through 8, and will then return to FIG. 1 to discuss the manner in which these components cooperate in the preferred embodiment.

Figure 2:
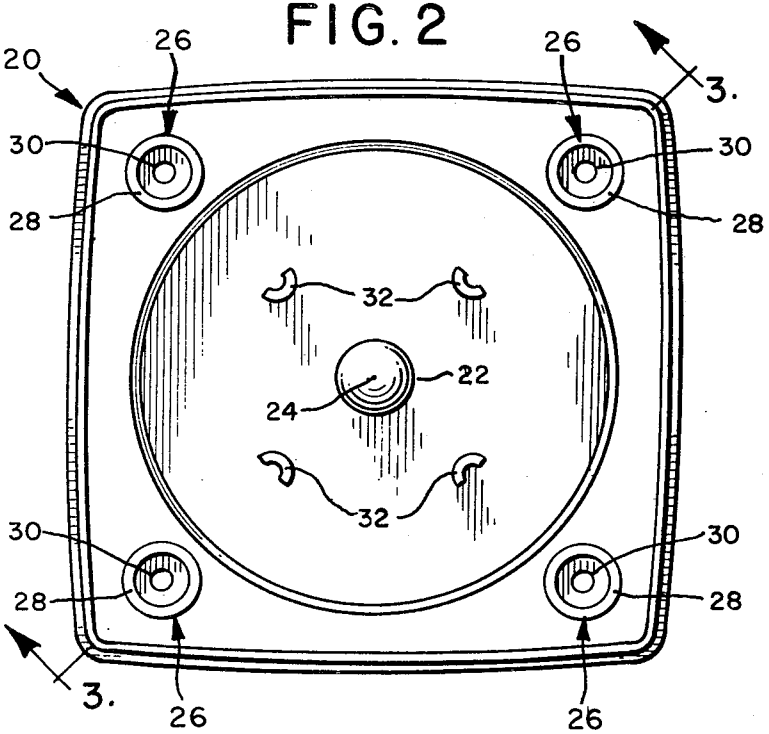
FIG. 2 is a top plan view of the lower housing 20 of the FIG. 1.
Figure 3:
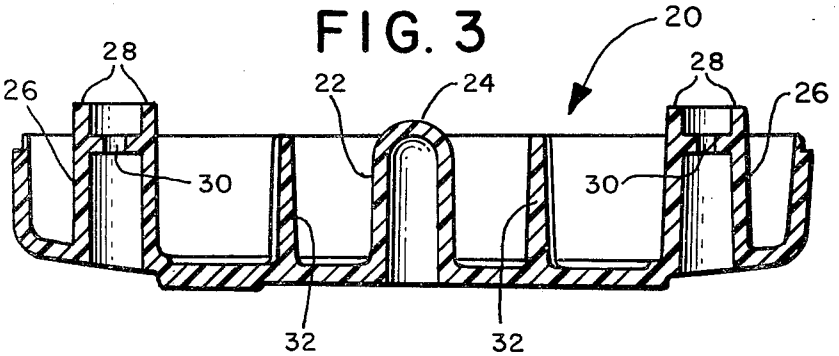
FIG. 3 is a sectional view taken along line 3—3 of FIG. 2.

Turning now to FIGS. 2 and 3, the lower housing 20 is a generally rectangular shell having an outer wall and a number of protruding interior components. Centrally situated is a central, cylindrical post 22 which extends up from the bottom of the lower housing 20 and terminates at its upper end in a lower spherical bearing surface 24. In this preferred embodiment, the radius of curvature of the bearing surface 24 is 0.25 inches. The lower housing 20 also defines four spaced legs 26, each of which defines a respective upper clamping surface 28. Each of the legs 26 defines a central opening 30 therein, which is sized to receive a fastener 130 as will be described in detail below in connection with FIG. 1. In addition, the lower housing 20 defines four spaced locking members 32, each of which is situated between the central post 22 and respective one of the legs 26.

Figure 4:
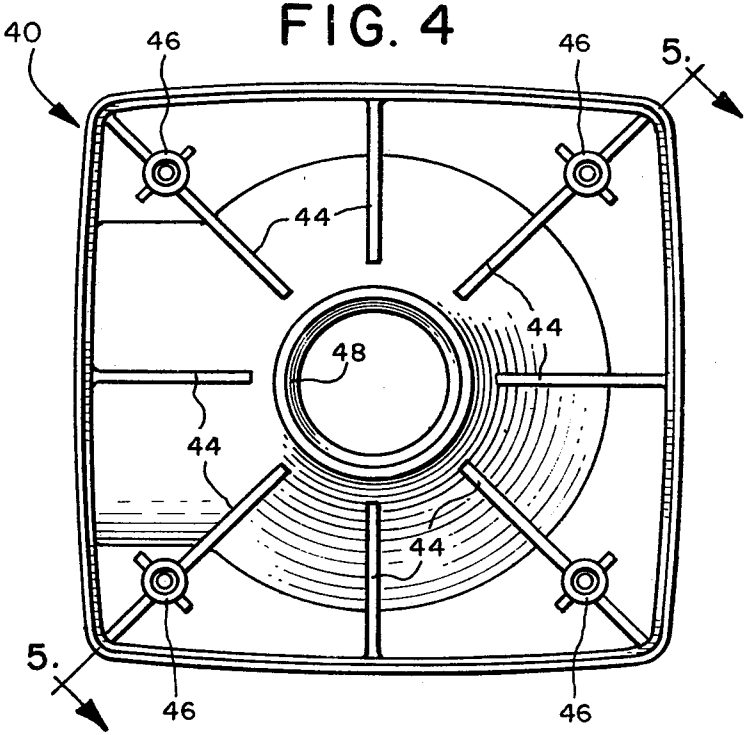
FIG. 4 is a bottom plan view of the upper housing 40 of FIG. 1.
Figure 5:
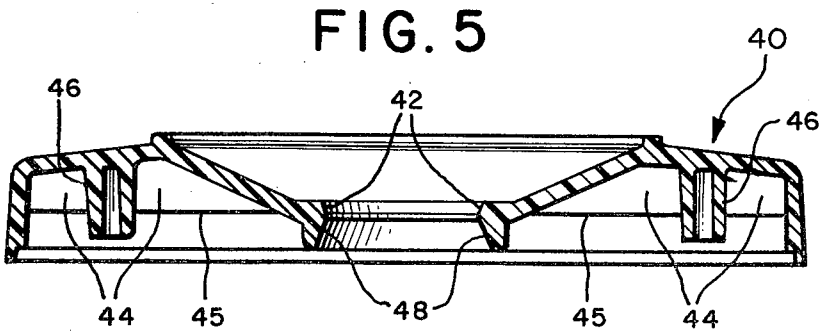
FIG. 5 is a sectional view taken along line 5—5 of FIG. 4.

FIGS. 4 and 5 show bottom plan and sectional views, respectively, of the upper housing 40. As shown in these figures, the upper housing 40 defines a central opening 42 and a plurality of ribs 44 extending from the periphery of the upper housing 40 to the central opening 42. All of these ribs 44 have a coplanar lower surface 45. In addition, the upper housing 40 defines four spaced sockets 46, each of which is aligned with a respective one of the legs 26 of the lower housing 20. Situated immediately inside the central opening 42 is an upper spherical bearing surface 48. When the upper housing 40 is assembled with the lower housing 20, the upper bearing surface 48 is concentric with the lower bearing surface 24. In this preferred embodiment, the radius of curvature of the upper bearing surface 48 is 0.625 inches. As shown in FIG. 1, an opening 50 is formed on one side of the upper housing 40.

Figure 6:
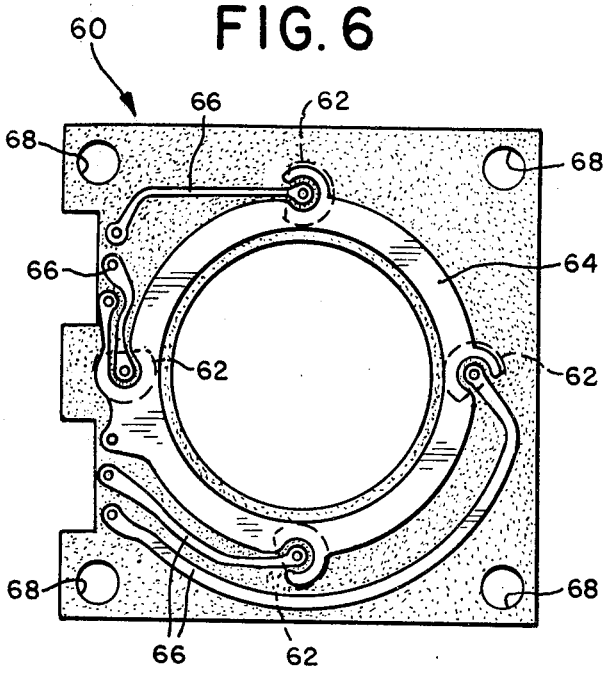
FIG. 6 is a bottom plan view of the circuit board 60 of FIG. 1.

FIG. 6 shows a bottom plan view of the circuit board 60. As shown in FIG. 6, the circuit board 60 serves to mount four symmetrically positioned dome switches 62. The circuit board 60 also supports a number of printed circuits 64, 66. The printed circuit 64 is an outer conductor which serves as a common electrode for each of the four dome switches 62. There are four of the printed circuits 66, each of which serves as an inner conductor for a respective one of the dome switches 62. The circuit board 60 defines four spaced apertures 68, each of which is aligned with a respective one of the sockets 46.

This preferred embodiment utilizes dome switches of the type distributed by K. B. Denver Co. of Frederick, Colo. as part number FS-1-77-20. These dome switches include conductive metallic domes having perimeters which are an electrical contact with the outer conductor 64. These dome switches 62 operate such that when in the rest position no electrical contact is provided between the outer conductor 64 and the respective inner conductor 66. However, when the dome switch 62 is flexed inwardly, toward the circuit board 60, it forms an electrical connection between the outer and inner conductors 64, 66. Such dome switches are well known in the art, and will not therefore be described in detail here.

Figure 7:
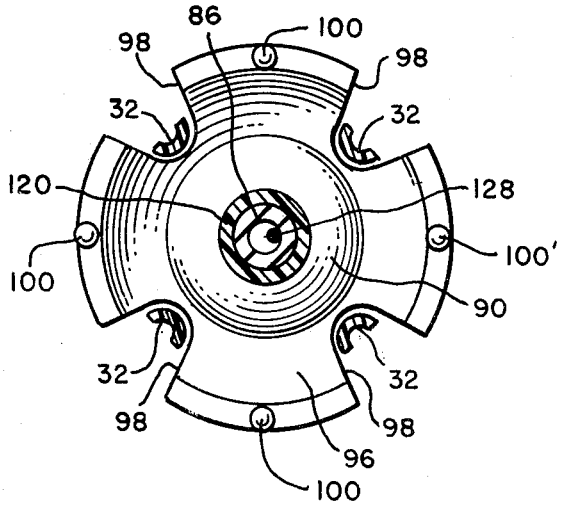
FIG. 7 is a sectional view taken along line 7—7 of FIG. 1.

FIGS. 1 and 7 provide views of the handle 80, which is provided with an upper end 82 and a lower end 84. The handle 80 includes a tube 86 which defines a central, axially extending bore 88. This tube 86 extends between the upper and lower ends 82, 84 of the handle 80. The handle 80 defines at its lower end 84 an outer bearing surface 90. In this preferred embodiment, this outer bearing surface 90 spherical and is provided with a radius of curvature of 0.625 inches. The handle 80 also defines an inner bearing surface 92, which is concentric with the outer bearing surface 90. The inner bearing surface 92 includes an upper spherical section and a lower conical section which has been flaired to allow pivotal movement of the handle 80 about the post 22. An aperture 94 is provided in the handle 80 extending between the inner and outer bearing surfaces 90, 92 and communicating with the bore 88 of the tube 86. A plate 96 is secured to the lowermost edge of the outer bearing surface 90. As shown in FIG. 7, this plate 96 defines four notches or cutouts 98. Four protrusions 100, 100' are centered on the four remaining portions of the plate 96. Three of these protrusions 100 are of equal height and situated in a common plane. The fourth protrusion 100' is elongated to extend above the plane of the three protrusions 100.

Figure 8:
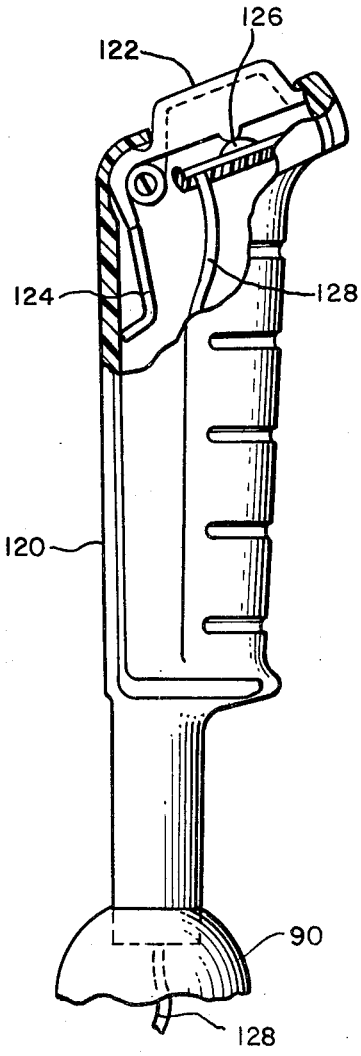
FIG. 8 is a side elevational view in partial cutaway of the grip 120 of FIG. 1.

FIG. 8 shows a side view of the grip 120 which is secured to the tube 86 of the handle 80. This grip 120 is designed to provide a comfortable grip for the user of the joystick controller. The grip 120 includes a thumb switch actuator 122 which is pivotally mounted to the grip 120. This actuator 122 includes an integral spring element 124 which is formed in one piece with, and of the same material as, the thumb switch actuator 122. This spring element 124 biases the thumb switch actuator 122 upwardly, away from the lower and upper housings 20,40. By molding the spring element 124 in one piece with the switch actuator 122, a simple, low cost, one piece design is obtained. A dome switch 126 is mounted within the grip 120 above the tube 86. This dome switch 126 is positioned beneath the actuator 122 such that downward movement of the actuator 122 actuates the dome switch 126. Two wires 128 are connected to the dome switch 126 and are passed downwardly through the bore 88 of the tube 86, through the aperture 94 of the handle 80, into the region between the circuit board 60 and the lower housing 20.

Returning now to FIG. 1, the manner in which the components described above cooperate to provide an improved joystick-type video game controller can now be described. As shown in FIG. 1, when the lower housing 20 is secured to the upper housing 40 by means of the fasteners 130 extending between the legs 26 and the sockets 46, the two spherical bearing surfaces 24, 48 are concentric. The upper bearing surface 48 cooperates with the outer bearing surface 90 of the handle, and the lower bearing surface 24 cooperates with the inner bearing surface 92 of the handle. In this way, the two bearing surface 90, 92 of the handle are captured between the two bearing surfaces 48, 24 of the housings 40, 20. A coil spring 110 is positioned around the central post 22 and extends between the lower housing 20 and the lower end 84 of the handle 80. The spring 110 serves to bias the handle 80 into a central position, as shown in FIG. 1. In this central position, none of the protrusions 100, 100' is in contact with any of the dome switches 62 mounted on the circuit board 60. As shown in FIG. 1, the circuit board 60 is clamped between the coplanar surfaces 45 of the ribs 40 and the clamping surfaces 28 of the legs 26. Thus, the circuit board 60 is securely held in position and braced against distortion. This is important, because the circuit board 60 serves as a mounting surface for the dome switches 62. The locking members 32 fit within the cutouts 98 to maintain the protrusions 100, 100' in alignment under the respective dome switches 62.

As shown in FIG. 1, the elongated protrusion 100' is significantly closer to the circuit board 60 than are the other protrusions 100 when the handle 80 is in the central position shown in FIG. 1. Because the four dome switches 62 are coplanar and extend substantially the same height below the circuit board 60, this means that the elongated protrusion 100' is closer to the respective dome switch 62 than are the other protrusions 100 when the handle 80 is in the central position. In use, the elongated protrusion 100' is situated to the front of the lower housing 20 such that a smaller angular excursion of the handle 80 rearwardly is required to activate the dome switch 62 associated with the elongated protrusion 100' than is required to actuate any of the other three dome switches 62. This has been found to enhance the convenience of the joystick controller considerably, because most users find it more difficult to move the handle 80 rearwardly to a large angle than to move in other directions to a large angle.

The four bearing surface system for mounting the handle 80 to the upper and lower housings 40, 20 provides important advantages in terms of smooth operation, even when axial forces are applied downwardly on the handle 80. The spring 110 serves to ensure that in normal operation it is the outer bearing surface 90 which bears against the upper bearing surface 48 to support the handle 80. However, when downwardly oriented forces are applied to the handle 80 during play, the spring 110 is compressed somewhat and the handle 80 is supported by the lower spherical bearing surface 24 of the post 22. Because this lower bearing surface 24 is concentric with the other three bearing surfaces, there is no tendency for the handle 80 to change its orientation when support for the handle 80 is shifted from the upper bearing surface 48 to the lower bearing surface 24. This cooperation between the four bearing surfaces provides a joystick controller with exceptionally smooth operation, even in the face of large axial forces on the handle 80. In order further to smooth the operation and movement of the handle 80, the handle 80 is preferably formed of a polypropylene, and the lower and upper housing 20, 40 are formed of an ABS material. The combination of an ABS material and polypropylene as opposed bearing surfaces provides a selflubricating joint. In this embodiment the grip 120 is also formed of an ABS material and the thumb switch actuator 124 is formed of polypropylene. The wires 128 which pass down the tube 86 via the bore 88 pass out of the tube 86 via the aperture 94. These wires 128 are then joined with other wires (not shown) connected to the circuit board 80, which pass out of the aperture 50 in the upper housing 40.

Another important advantage of this preferred embodiment is that it greatly facilitates alignment of the various components. Because the circuit board 60 serves to mount the dome switches 62 and the circuit board 60 is securely held in place, centered by the sockets 46 of the upper housing 40, alignment between the dome switches 62 and the protrusions 100, 100' is readily maintained. This is in large part due to the fact that it is the upper housing 40 which both locates the handle 80 by means of the upper bearing surface 48, and also locates the circuit board 60 by means of the sockets 46.

As described above, the preferred embodiment illustrated in the drawings utilizes a trigger switch mounted at the upper end of the handle so as to be actuated by the thumb of the user. This placement for the trigger switch is convenient in use, because it is as easily operated by left-handed users as by right-handed users.

Of course, it should be understood that various changes and modifications to the preferred embodiment described above will be apparent to those skilled in the art. For example, exact dimensions and materials can be modified readily to suit the intended application, and other types of switches may be substituted for the dome switches. Furthermore, the various features of the invention described above have independent utility, and these features can be incorporated in alternate embodiments, either alone or in combination with other features discussed above. For example, the use of switch actuators of varying heights is not confined to controllers utilizing the double ball suspension structure described above. Conversely, the double ball suspension construction described above can be used in devices having four switch actuators of equal height.

It is therefore intended that the foregoing detailed description be regarded as illustrative rather than limiting, and that it be understood that it is the following claims, including all equivalents, which are intended to define the scope of this invention.

We claim:

1. A video game controller comprising:

a joystick handle defining a longitudinal axis and having a lower end portion which defines first and second concentric bearing surfaces spaced along the longitudinal axis;

a housing sized to receive and support the lower end portion of the joystick handle, said housing defining third and fourth concentric bearing surfaces positioned to mate with and support the first and second bearing surfaces, respectively, with the second bearing surface nested within the first bearing surface such that the first and second bearing surfaces are captured between the third and fourth bearing surfaces to provide a smooth pivotal motion to the handle for a range of positive and negative axial forces on the handle, yet the joystick handle is free to pivot about the center of the first and second bearing surfaces;

spring means for biasing the joystick handle to a central position; and switch means for sensing the pivotal position of the joystick handle;

said first and fourth bearing surfaces being convex, said second and third bearing surfaces being concave, the radii of curvature of the first and third bearing surfaces being substantially equal, the radii of curvature of the second and fourth bearing surface being substantially equal, and the radius of curvature of the second bearing surface being less than that of the first.

2. The invention of claim 1 wherein the fourth bearing surface is defined by an upper surface of a post secured to the housing and the spring means comprises a coil spring disposed around the post and extending between the housing and the lower end portion of the joystick handle.

3. The invention of claim 1 wherein the sensing means comprises:

four upwardly pointing protrusions secured to the end portion of the joystick handle within the housing; and four digital switches, each mounted within the housing above a respective one of the four protrusions such that each of the switches is actuated by a respective one of the protrusions when the joystick handle is positioned within a respective range of positions.

4. The invention of claim 3 wherein the separation between a selected one of the protrusions and the respective switch is less than the separation between the other protrusions and the respective switches when the joystick handle is in the central position, such that less motion of the joystick handle is required to cause the selected protrusion to actuate the respective switch than is required to cause the other protrusions to actuate the respective switches.

5. The invention of claim 1 further comprising an additional thumb actuated switch mounted in the joystick handle near an upper end of the handle.

6. A video game controller comprising:

a joystick handle having an upper end and a lower end;

a housing;

means for pivotably mounting the lower end of the handle to the housing such that the handle is pivotably movable forwardly, rearwardly, to the right, and to the left with respect to the housing;

four switch actuators mounted to the lower end of the handle;

four switches mounted to the housing, each in alignment with a respective one of the switch actuators such that a first one of the four switches is actuated when the handle is moved rearwardly and respective other ones of the four switches are actuated when the handle is moved forwardly, to the right, and to the left; and means for biasing the handle to a central position in which none of the switches is actuated;

the spacing between the first switch and the respective actuator when the handle is in the central position being less than the spacing between any of the other switches and the respective actuators when the handle is in the central position, such that a lower angular departure of the handle from the central position is required to actuate the first switch than any of the other switches.

7. The invention of claim 6 wherein the handle includes a plate secured to the lower end of the handle and the four switch actuators are mounted on the plate.

8. The invention of claim 6 wherein each of the actuator comprises a respective rounded protrusion and the height of the protrusion aligned with the first switch is greater than that of any of the other protrusions.

9. The invention of claim 6 wherein the housing comprises upper and lower housing components, wherein the upper housing component is positioned between the lower housing component and the upper end of the handle, wherein the four switches are mounted on a circuit board, wherein the circuit board is mounted to the upper housing component, and wherein the switch actuators are positioned between the lower housing component and the circuit board.

10. The invention of claim 6 wherein a thumb actuated switch is mounted in the upper end of the handle.

11. The invention of claim 10 wherein the trigger switch comprises:

an electrical switch mounted in the upper end of the handle; and an actuating member pivotably mounted in the upper end of the handle to actuate the electrical switch, said actuating member comprising an integral spring element formed in one piece therewith which contacts the handle to bias the actuating member away from the electrical switch.

12. A video game controller comprising:

a lower housing defining a central cylindrical post having a convex first spherical bearing surface at an upper end thereof;

an upper housing secured to the lower housing and defining a central opening above the first bearing surface and a concave second spherical bearing surface around the central opening;

a circuit board mounted to the upper housing;

four switches mounted to the circuit board and extending below the circuit board, between the circuit board and the lower housing, said switches symmetrically positioned around the central opening;

a joystick handle having an upper end and a lower end, said lower end defining a concave third spherical bearing surface adjacent the first bearing surface and a convex fourth bearing surface adjacent the second bearing surface, the four bearing surfaces being concentric, with the radius of curvature of the first and third bearing surfaces being less than that of the second and fourth bearing surfaces, said third bearing surface being nested within said fourth bearing surface;

a coil spring positioned around the cylindrical post and extending between the lower housing and the lower end of the joystick handle to bias the handle to a central position;

four switch actuators secured to the lower end of the joystick handle, each under a respective one of the four switches such that for each of the four switches, movement of the joystick handle into a respective range of positions causes the respective actuator to actuate the switch, one of the four switch actuators extending closer to the respective switch than the other switch actuator to their respective switches when the handle is in the central position such that a reduced angular departure of the joystick handle from the central position is required to actuate the switch associated with said one of the four switch actuators than is required to actuate the remaining switches, said one of the four switch actuators associated with rearward movement of the joystick handle.

13. The invention of claim 12 further comprising:

a thumb actuated trigger switch mounted on the upper end of the joystick handle; and at least one wire extending from the trigger switch, down a bore formed in the joystick handle, through an opening formed between the third and fourth bearing surfaces, into the region between the circuit board and the lower housing.

* * * * *